United States Patent [19]

Ishii et al.

[11] Patent Number: 4,482,838

[45] Date of Patent: Nov. 13, 1984

[54] THERMIONIC EMISSION CATHODE

[75] Inventors: Masaji Ishii; Hirotoshi Hagiwara; Hideo Hiraoka, all of Machida, Japan

[73] Assignee: Denki Kagaku Kogyo Kabushiki Kaisha, Tokyo, Japan

[21] Appl. No.: 327,467

[22] Filed: Dec. 4, 1981

[30] Foreign Application Priority Data

Dec. 9, 1980 [JP] Japan ..... 55-173415

[51] Int. Cl.[3] ..... H01J 1/16; H01J 19/10

[52] U.S. Cl. ..... 313/336; 313/346 R

[58] Field of Search ..... 313/336, 346; 252/509, 252/521; 316/18, 19

[56] References Cited

U.S. PATENT DOCUMENTS 4,054,946 10/1977 Ferris et al.

FOREIGN PATENT DOCUMENTS 54-51473 4/1979 Japan ..... 313/336

55-131945 10/1980 Japan ..... 313/336

OTHER PUBLICATIONS

R. Shimizu et al., Brightness of Single Crystal $LaB_6$ Cathodes of <100> and <110> Orientations, *Scanning Electron Microscopy*, I, pp. 11–18, 1979.

Tadahiro Takigawa, et al., Emission Characteristics for <100>, <110> and <111> $LaB_6$ Cathodes, *Japanese Journal of Applied Physics*, Vol. 19, No. 9, pp. L537–L540, 1980.

*Primary Examiner*—David K. Moore

*Assistant Examiner*—Robert E. Wise

*Attorney, Agent, or Firm*—Oblon, Fisher, Spivak, McClelland & Maier

[57] ABSTRACT

A thermionic emission cathode of a single crystal made of the calcium hexaboride type crystaline structure comprises a top surrounded by natural face inherent to the axial direction of the single crystal.

4 Claims, 13 Drawing Figures

THERMIONIC EMISSION CATHODE

BACKGROUND OF THE INVENTION

1. Field of the Invention

The present invention relates to a thermionic emission cathode which has shows less change of electron beam intensity emitted from a cathode as a function of time.

2. Description of the Prior Art

A thermionic emission cathode using a single crystal made of a compound having calcium hexaboride type crystalline structure has been used after forming a sharp edge of the single crystal chip by machining or electrolytic etching. The sharp edges of the cathodes which are formed by the conventional method are shown in FIGS. 1 to 3.

FIG. 1 shows the sharp edge (4) of the cathode formed by machining the edge of rectangular column single crystal (1) which has a conical surface (2) and a top (3) having a constant curvature.

FIGS. 2 and 3 show the sharp edge (4) of the cathode formed by electrolytic polishing of the edge of the single crystal (1). In FIG. 2, the top (3) of the single crystal is quite sharp (usually less than 1$\mu$ of a curvature at the top). In FIG. 3, the top (3) of the single crystal has a curvature of about 10 to 100$\mu$. In both cases, the edge (4) is a smooth curved surface.

The electron beam intensity emitted from the cathode changes as a function of time when the single crystal cathode is used as a cathode of an electron microscope etc.

SUMMARY OF THE INVENTION

It is an object of the present invention to overcome the disadvantages and to provide a thermionic emission cathode having less change of electron beam intensity as a function of time.

The foregoing and other objects of the present invention is attained by providing a thermionic emission cathode of a single crystal cathode having a calcium hexaboride type crystalline structure which has a top surrounded by natural face inherent to the axial direction of the single crystal which is formed by treating the edge of the single crystal cathode.

DETAILED DESCRIPTION OF THE PREFERRED EMBODIMENTS

Figure 4A:
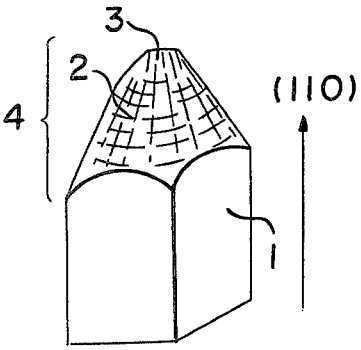
FIGS. 4 to 6 are respectively schematic views and plane views of edges of the thermionic emission cathodes of the present invention.
Figure 5A:
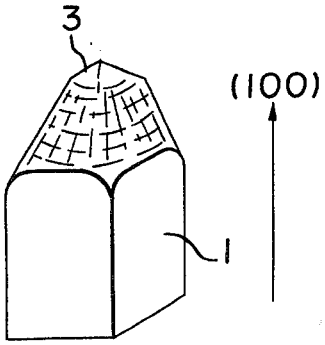
Figure 6A:
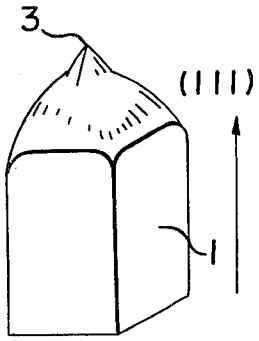
Figure 4B:
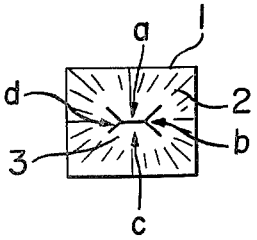
Figure 5B:
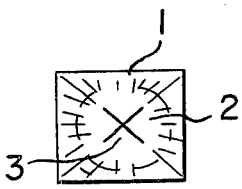
Figure 6B:
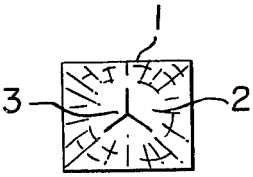

Referring to FIGS. 4 to 6, examples of thermionic emission cathodes obtained by the present invention will be illustrated.

Figure 1:
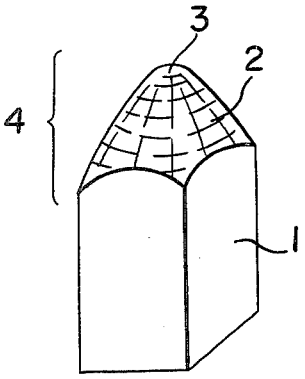
FIG. 1 PRIOR ART
FIGS. 1 to 3 are respectively schematic views of conventional thermionic emission cathodes of single crystals having calcium hexaboride type crystalline structure.
Figure 2:
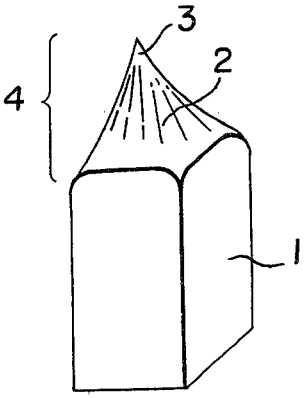
FIG. 2 PRIOR ART
Figure 3:
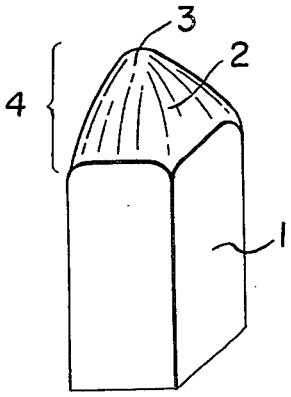
FIG. 3 PRIOR ART

When the single crystal cathodes shown in FIGS. 1 to 3 are respectively heated in vacuum or etched under a suitable condition, the surface of the top (3) of the cathode is removed by evaporation or dissolution to form a plurality of the natural faces inherent to the axial direction of the crystal. Thus, the top (3) is the polyhedron surrounded by natural faces. The examples are shown in FIGS. 4 to 6. FIG. 4(*a*) shows the edge of the single crystal (1) having <110> axial direction (the cathode obtained by the machining which is shown in FIG. 1 is treated) and the top (3) of the cathode is surrounded by four natural faces in a form of hip roof. FIG. 4(*b*) shows the top of the cathode in view of the upper position. It is found that the top (3) is surrounded by the natural faces (a), (b), (c), (d) in <110> axial direction. In the treatment, sometimes, the natural faces are formed on all of the curved surfaces (2) of the edge (4) of the cathode, however, it is enough to form the natural faces on only the top of the edge (4) of the cathode. The natural face can be plane or curved surface. Both of plane and curved natural faces can be applied to the purpose of the present invention. As shown in the following example, it can be the combination of the plane and curved natural faces.

FIGS. 5 and 6 respectively show the edges of the cathodes obtained by heating, in vacuum, the cathodes obtained by electrolytic polishing shown in FIGS. 2 and 3. FIG. 5 shows the edge of the cathode having <100> axial direction and FIG. 6 shows the edge of the cathode having <111> axial direction. In the case of <100> axial direction, the top (3) is changed in the form of tetrahedron and in the case of <111> axial direction, the top (3) is changed in the form of trihedron.

The preparation of the single crystal cathode having a top surrounded by the natural faces will be illustrated.

(1) Vacuum heating method:

The conventional cathode shown in FIGS. 1 to 3 is heated at 800° to 1900° C. in vacuum of $10^{-3}$ Torr to $10^{-9}$ Torr. The heating time is depending upon the temperature and the vacuum degree. When the vacuum degree is low and the temperature is high, the heating time can be relatively short such as several minutes to 1 hour. When the vacuum degree is high and the temperature is low, the heating time can be relatively long such as 50 to 200 hours. When the temperature is lower than 800° C., the speed of evaporation of the edge is too low and the natural faces are not easily given, disadvantageously. When the temperature is higher than 1900° C., the speed of evaporation is too high and the formation of the natural faces is not easily controlled disadvantageously. When the vacuum degree is lower than $10^{-3}$ Torr, the surface of the single crystal is covered with the oxide and the electron beam intensity is disadvantageously unstable in the use of the cathode. When the vacuum degree is higher than $10^{-9}$ Torr, the speed of formation of the natural faces is too low in the practical operation. The heat treatment is usually carried out at 1400° to 1650° C. in vacuum of $10^{-6}$ Torr for 3 to 100 hours. It is possible to give residual gas ion impulse to the edge of the cathode by applying high voltage between the edge of the cathode and an anode placed near the cathode in the heat treatment.

(2) Chemical etching:

The natural faces can be formed on the edge of the cathode by chemical etching. The typical etching solution used in the process is preferably an aqueous solution of nitric acid. The time for chemical etching is in a range of 20 to 300 seconds and a concentration of nitric acid is 20 wt. % or higher. It is also possible to use the other known etching solution. In the chemical etching, the natural faces are formed on all of the edge (4) of the cathode which is different from the result of the vacuum heat treatment. The electrolytic etching is not suitable for the purpose of the present invention because of difficulty of the formation of the natural faces inherent to the axial direction.

It is not clearly found the reason why the timing change of electron beam intensity is reduced by the formation of the natural faces on the edge of the cathode. It is considered that the natural faces are different from the forcibly processed faces to have high thermodynamical stability and to cause less change of the structure under the condition using the cathode.

As described, in accordance with the present invention, the conventional single crystal thermionic emission cathode having the calcium hexaboride type structure is treated by a suitable method to form the edge of the cathode surrounded by a plurality of the natural faces inherent to the axial direction of the single crystal thereby providing an improved thermionic emission cathode having the edge surrounded by the natural faces which has less timing change of electron beam intensity.

Various axial directions of the single crystal can be considered as crystalline forms. It is the feature of the present invention to form the natural faces and it is possible to select any axial direction in the present invention.

In accordance with the present invention, the natural faces are formed on the top of the thermionic emission cathode. The faces of the top of the single crystal made of calcium hexaboride type crystalline structure have portions having different evaporation, different oxidized consumption speed or different acid solubilization speed when the top is shaped in sharp in the prior art such as U.S. Pat. No. 4,054,946. Thus, the sharp top is treated by the heating in vacuum or the chemical etching whereby portions of the sharp top are removed by the evaporation or the etching to remain the natural faces which may have the substantially same sharp top having rough surfaces. The natural faces are stable and the similar form of the sharp top is maintained by the treatment such as the heating in vacuum and the chemical etching.

The present invention will be further illustrated by certain examples and references which are provided for purposes of illustration only and are not intended to be limiting the present invention.

EXAMPLE 1

Figure 7:
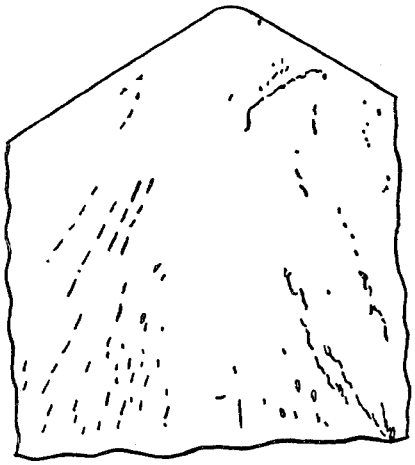
FIG. 7 PRIOR ART
FIG. 7 shows the edge of the conventional thermionic emission cathode.
Figure 8:
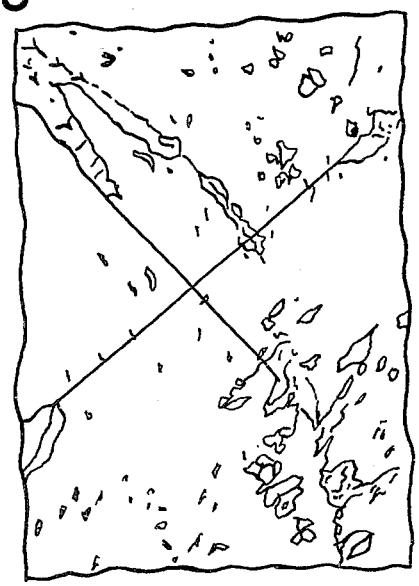
FIG. 8 shows the edge of the thermionic emission cathode of the present invention.
Figure 9:
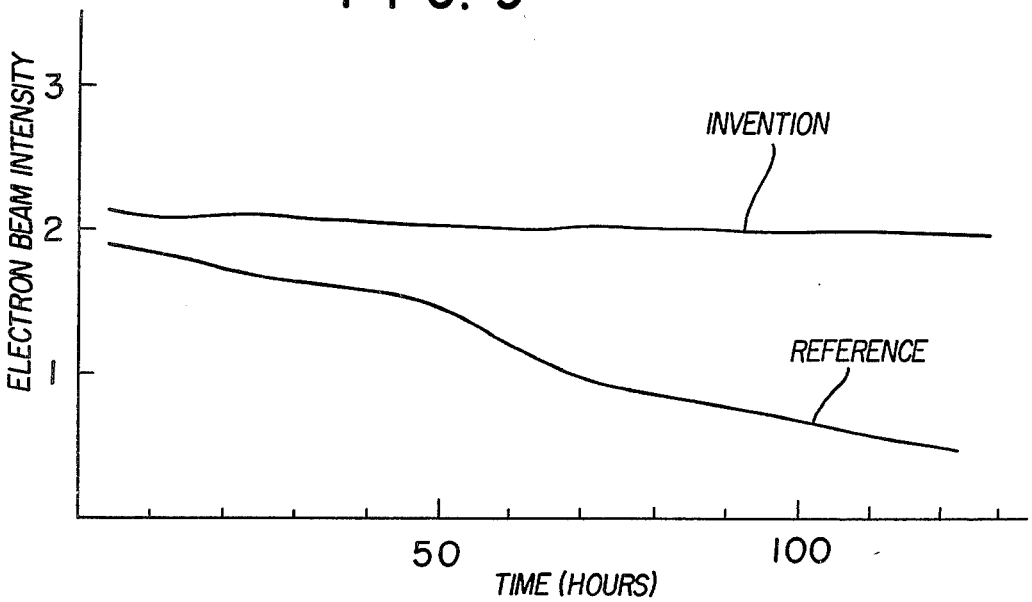
FIGS. 9 and 10 are respectively graphs of timing changes of electron beam intensities of the cathode of the present invention and the conventional cathode.

A single crystal cathode having a <100> axial direction shown in FIG. 1 was produced by a machining method from a lantanum hexaboride single crystal block. The edge of the cathode is shown in FIG. 7. The cathode was chemically polished in 30% aqueous solution of nitric acid for 180 seconds whereby the natural face shown in FIG. 8 was formed at the edge of the cathode. The cathode having the edge surrounded by the natural face and the conventional cathode shown in FIG. 7 as the reference were respectively used as the cathode of a scanning electron microscope and each timing change of electron beam intensity (electric current) emitted from each cathode under the condition of an acceleration voltage of 25 kV and a bias of 16 MΩ was measured. The results are shown in FIG. 9.

EXAMPLE 2

Figure 10:
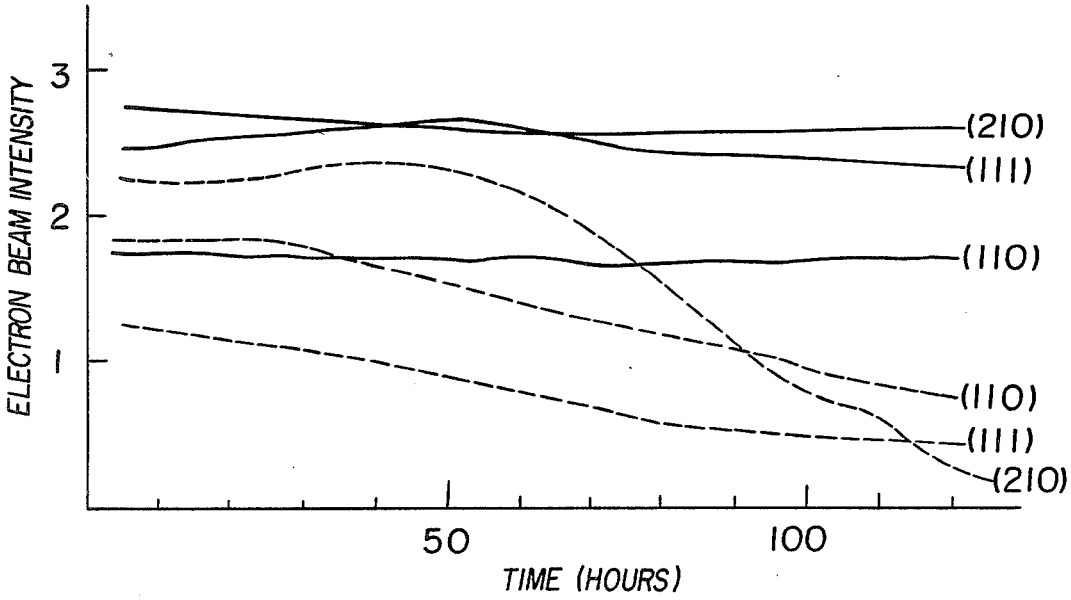

A single crystal cathode having <110>, <111> and <210> axial directions shown in FIG. 3 was produced by electrolytic polishing method from a lantanum hexaboride single crystal block. The cathode was heated at 1450° C. in vacuum of $8\times10^{-6}$ Torr for 15 hours to form the edge surrounded by the natural face. As a reference, the cathode having <110>, <111> and <210> axial directions was also used. Each timing change of electron beam intensity emitted from each cathode was measured under the condition of Example 1. The results are shown in FIG. 10 wherein the full line shows the timing change of electron beam intensity emitted from the cathode having the edge surrounded by the natural face and the dotted line shows the timing change of electron beam intensity emitted from the conventional cathode.

In accordance with the present invention, the conventional thermionic emission cathode of a single crystal having the calcium hexaboride type crystalline structure is treated by a suitable method to form the edge surrounded by natural face inherent to the axial direction of the single crystal for the cathode whereby the timing change of electron beam intensity is reduced and the life of the cathode is prolonged and stable electron beam having high brightness can be emitted.

We claim:

1. A thermionic emission cathode of a single crystal made of calcium hexaboride type crystalline structure which comprises a top surrounded by natural faces inherent to the axial direction of the single crystal said cathode being thermodynamically stable and said faces being formed by chemical etching or by treatment under heat-evaporation in vacuum.

2. The thermionic emission cathode according to claim 1 wherein said natural face of the single crystal inherent to the axial direction is formed by chemical etching.

3. The thermionic emission cathode according to claim 1 wherein said natural face of the single crystal inherent to the axial direction is formed by heating in vacuum of $10^{-3}$ to $10^{-9}$ Torr at 800° to 1900° C.

4. The thermionic emission cathode according to claim 1 wherein said cathode is made of lanthanum hexaboride.

* * * * *